US006468047B1

(12) United States Patent
Huang et al.

(10) Patent No.: US 6,468,047 B1
(45) Date of Patent: Oct. 22, 2002

(54) POWER PUMP DEVICE

(76) Inventors: Ying-Che Huang, No. 3-1, Lane 572, Sec. 2, Chung Cheng Road, Chuang Hwa (TW); Chun-Ming Huang, No. 240, Chung Hwa W.Road, Chang Hwa (TW)

( * ) Notice: Subject to any disclaimer, the term of this patent is extended or adjusted under 35 U.S.C. 154(b) by 0 days.

(21) Appl. No.: 09/863,785

(22) Filed: May 22, 2001

(51) Int. Cl.[7] ..... F04B 49/00; F04B 35/00; F16D 23/00

(52) U.S. Cl. ..... 417/223; 417/319; 192/56.6

(58) Field of Search ..... 417/223, 319; 192/44, 45, 56.6, 56.62; 464/47, 39

(56) References Cited

U.S. PATENT DOCUMENTS 3,767,019 A * 10/1973 Wingler ..... 192/105 B
4,118,151 A * 10/1978 Murakami et al. ..... 192/91 A
4,678,164 A * 7/1987 Yang ..... 254/1
4,823,885 A * 4/1989 Okumura ..... 173/178
5,215,447 A * 6/1993 Wen ..... 417/319
5,356,350 A * 10/1994 Schreiber ..... 192/150
6,045,303 A * 4/2000 Chung ..... 192/56.57

* cited by examiner

*Primary Examiner*—Cheryl J. Tyler
*Assistant Examiner*—Timothy P. Solak

(57) ABSTRACT

A power pump device includes a casing having a motor and a gear system is connected to an output shaft of the motor. A final gear of the gear system is mounted to an axle and a knob is rotatably and threadedly connected to the casing. A first spring is mounted to the axle and biased between the final gear and an inside of the knob. A disk is mounted to the axle and a clutch device is engaged between the final gear and the disk. A crank is connected to the axle and connected to a piston rod which reciprocatingly moves in a cylinder so as to output pressurized air. The clutch device makes the final gear to slide on the disk when a back pressure overcomes the spring biasing the final gear.

6 Claims, 3 Drawing Sheets

POWER PUMP DEVICE

FIELD OF THE INVENTION

The present invention relates to a power pump device having a clutch device for disengaging the torque from the motor shaft to the piston rod to prevent unexpected high pressure in the object to be inflated.

BACKGROUND OF THE INVENTION

A conventional pump device for inflating object such as balls or tires generally includes two types, one of which is manual pump and the other one is power pump. The manual pump includes a cylinder with a piston movably received therein and a piston rod can be held by the operators to reciprocatingly operate the piston rod to output pressurized air. This type of pump is easily to be carried but cannot output a higher pressure. Power pumps are powered by a motor which generates a huge force to operate a piston movement so as to output higher pressure. However, the power pumps are bulky and expensive. In addition, the pressure could be unexpected high within a short period of time so that it is not suitable to be used for inflating inflatable toys or small inflatable objects.

The present invention intends to provide a power pump device that has a compact casing and has a clutch device that effectively controls the pressure output.

SUMMARY OF THE INVENTION

In accordance with one aspect of the present invention, there is provided a power pump device and comprises a casing having a motor and a gear system is connected to an output shaft of the motor. A final gear of the gear system is mounted to an axle which extends from a frame in the casing and through the casing. A knob is rotatably and threadedly connected to the casing and a first spring is mounted to the axle and biased between the final gear and an inside of the knob. A disk is mounted to the axle and a clutch device is engaged between the final gear and the disk. A crank is connected to the axle and connected to a piston rod and a piston is connected to the piston rod. A cylinder is connected to the casing and a tube connected in communication with the cylinder. A valve is connected to the tube and the piston is movably received in the cylinder.

The primary object of the present invention is to provide a power pump device that a clutch device is controlled to release the output torque of the motor from the piston rod at pre-set pressure.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
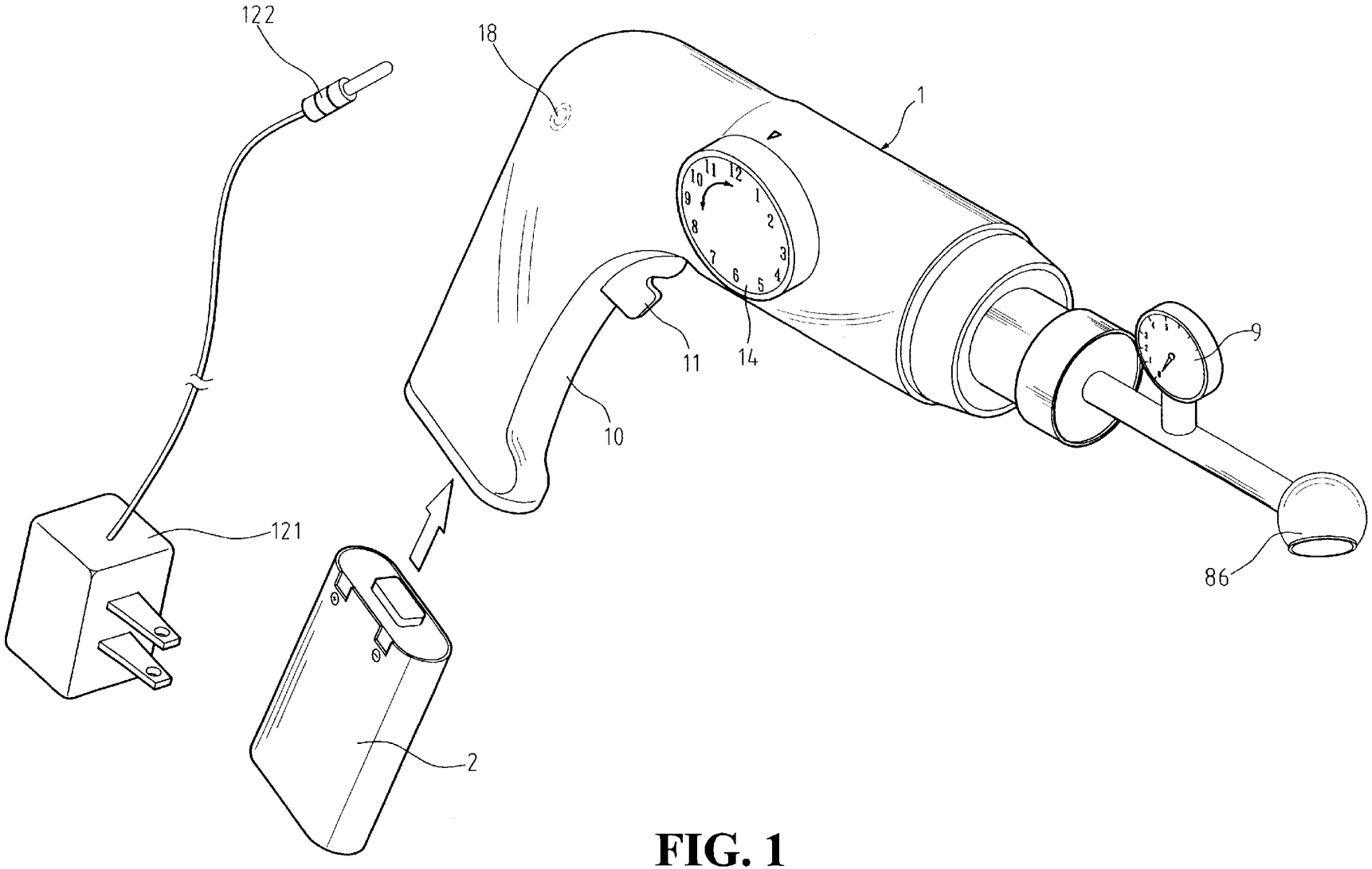
FIG. 1 is an exploded view to show a power pump device of the present invention.
Figure 2:
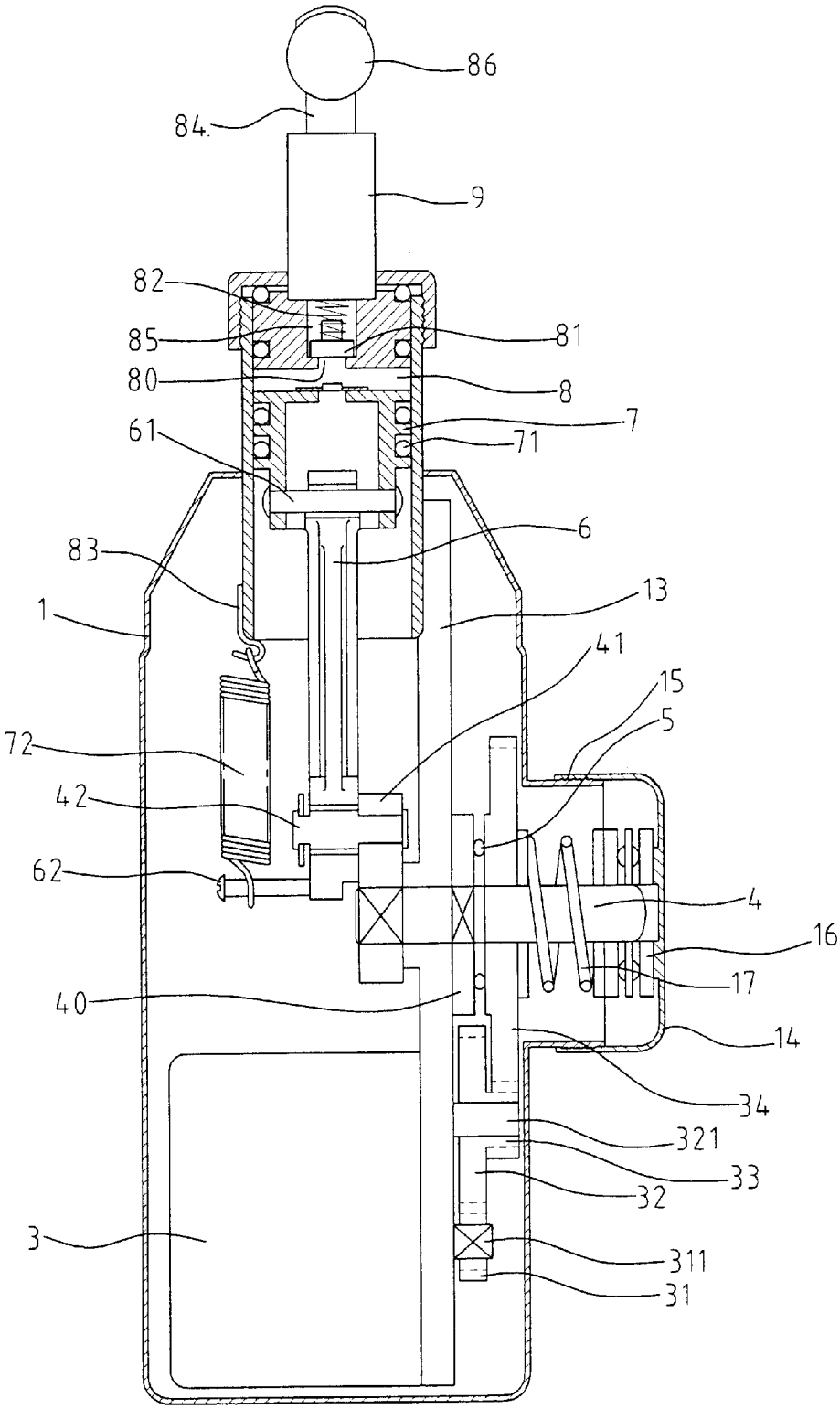
FIG. 2 is a top cross sectional view to show the power pump device of the present invention.
Figure 3:
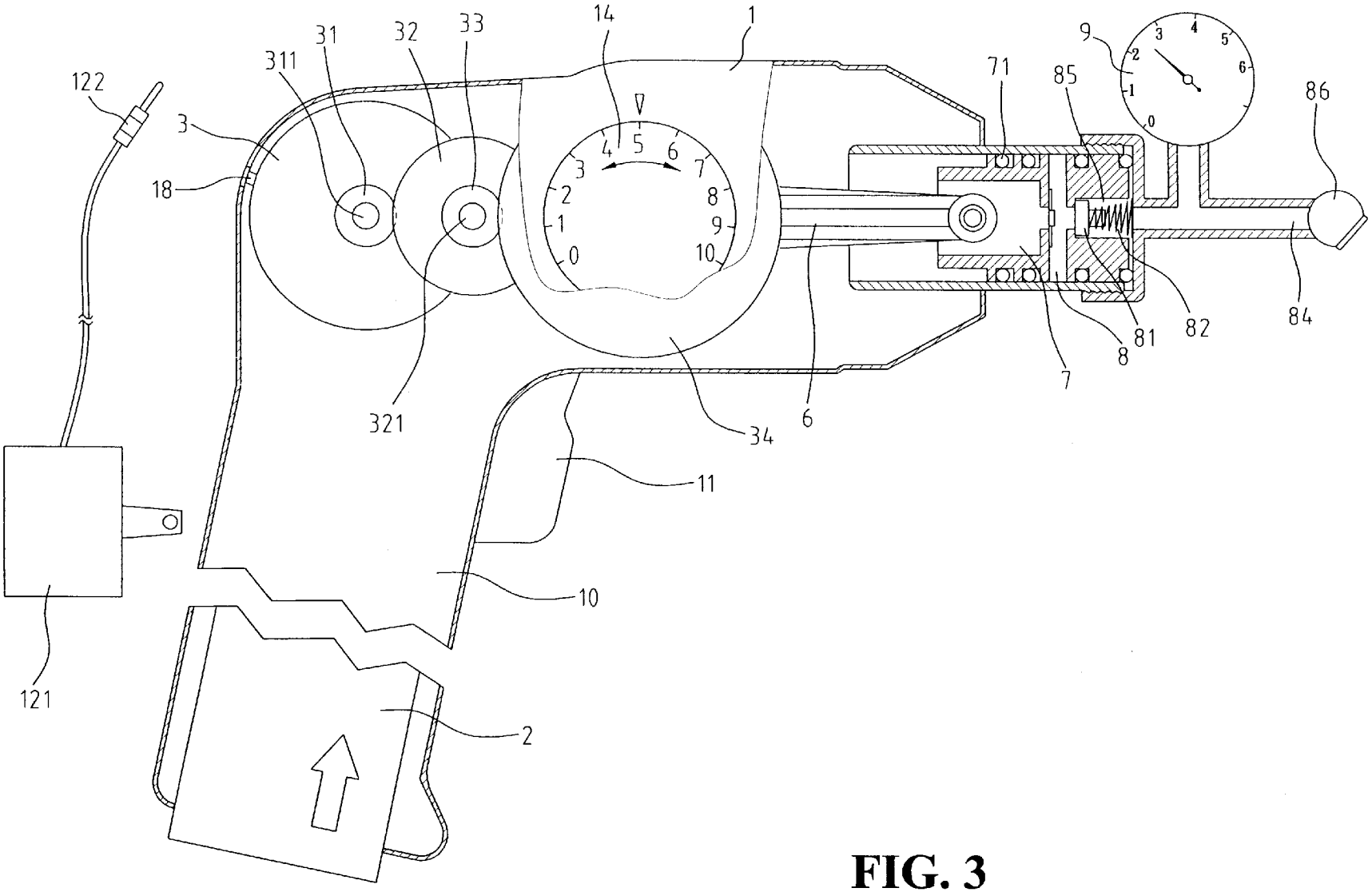
FIG. 3 is an illustrative view to show a connection between the gear system and the output shaft of the motor in the power pump device of the present invention.

Referring to FIGS. 1 to 3, the power pump device of the present invention comprises a casing 1 having a handle 10 for receiving a battery 2 therein. A receptacle hole 18 is defined in a side of the casing 1 so that a plug 122 of an adapter 121 can be inserted into the hole 18 to provide direct electric current to the power pump device when no battery is used. A trigger 11 is connected to the handle 10 so as to activate the a motor 3 received in the casing 1. A gear system is connected to an output shaft 311 of the motor 3 and includes a pinion 31 mounted to the output shaft 311 and is engaged with a first gear 32. Another pinion 33 is mounted to a common axle 321 of the first gear 32 and is engaged with a final gear 34 of the gear system. The final gear 34 is mounted to an axle 4 which extends from a frame 13 in the casing 1 and through the casing 1. A tubular portion 15 extends from the casing 1 and has threaded outer periphery. The axle 4 is located in the tubular portion 15 and a knob 14 is rotatably and threadedly connected to the tubular portion 15. A first spring 17 is mounted to the axle 4 and biased between the final gear 34 and an inside of the knob 14.

A disk 40 is mounted to the axle 4 and a clutch device 5 is engaged between the final gear 34 and the disk 40. The clutch device 5 includes a plurality of balls which are clamped between the disk 40 and the final gear 34 which is pushed by a force from the first spring 17 toward the disk 40. An anti-thrust bearing 16 is connected to the inside of the knob 14 and mounted the axle 4. A crank 41 is connected to the axle 4 and connected to a piston rod 6 by a connection pin 42 and a piston 7 is connected to the piston rod 6 by a pin 61. The piston 7 has a plurality of piston rings 71 mounted thereon and is movably received in a cylinder 8 connected to the casing 1. A tube 84 extends from the casing 1 and is connected in communication with the cylinder 8. A valve 86 is connected to a distal end of the tube 84 and a pressure gauge 9 is connected to the tube 84 to illustrate the pressure of the object to be inflated. A passage 85 is defined through an end of the cylinder 8 and communicates between the tube and an interior of the cylinder 8. An annular flange 80 extends inward from an inner periphery of the passage 85 and a block member 81 seals the passage 85. A second spring 82 is received in the passage 85 and biases the block member 81 to prevent air from entering the cylinder 8 from the object to be inflated.

The piston rod 6 has a pin 62 and a hook 83 is connected to the cylinder 8. A third spring 72 is connected to the hook 83 and the pin 62. The third spring 72 effectively balances the difference between the forward and rearward movement of the piston rod 6 during inflating the object.

The force that the first spring 17 applies on the final gear 34 can be set by rotating the knob 14 so that when inflating the object connected to the valve 86, the output torque from the motor 3 drives the final gear 34 and the disk 40 is rotated because the friction between the balls of the clutch device 5 and the disk 40 is larger than the resistance in the cylinder 8. When the object to be inflated reaches a desired valve set by the knob 14, the friction between the balls of the clutch device 5 and the disk 40 is less than the resistance in the cylinder 8 so that the disk 40 will not rotate by the friction force so that the balls can only roll on the disk 40. In other words, the final gear 34 is rotated itself on the axle 4 and the output of the motor 3 cannot be transferred to the crank 41. Therefore, the object is inflated at desired pressure.

While we have shown and described the embodiment in accordance with the present invention, it should be clear to those skilled in the art that further embodiments may be made without departing from the scope of the present invention.

What is claimed is:

1. A power pump device comprising:

a casing having a motor received therein and a gear system connected to an output shaft of said motor, a final gear of said gear system mounted to an axle which extends from a frame in said casing and through said casing, a knob rotatably and threadedly connected to said casing and a first spring mounted to said axle and biased between said final gear and an inside of said knob;

a disk mounted to said axle and a clutch device engaged between said final gear and said disk, said clutch device pushed by a force from said first spring toward said disk, and a crank connected to said axle and connected to a piston rod and a piston connected to said piston rod, a cylinder connected to said casing and a tube connected in communication with said cylinder, a valve connected to said tube, said piston movably received in said cylinder.

2. The power pump device as claimed in claim 1, wherein said clutch device includes a plurality of balls which are clamped between said disk and said final gear.

3. The power pump device as claimed in claim 1, wherein said casing has a tubular portion extending therefrom and said knob is theadedly connected to said tubular portion.

4. The power pump device as claimed in claim 1, wherein said piston rod has a pin and a hook is connected to said cylinder, a second spring connected to said hook and said pin.

5. The power pump device as claimed in claim 1, further comprising a passage defined through an end of said cylinder and said passage communicating between said tube and an interior of said cylinder, an annular flange extending inward from an inner periphery of said passage and a block member sealing said passage, a third spring received in said passage and biased said block member.

6. The power pump device as claimed in claim 1, further comprising a pressure gauge connected to said tube.

* * * * *